US012156587B2

(12) United States Patent
Allen

(10) Patent No.: US 12,156,587 B2
(45) Date of Patent: Dec. 3, 2024

(54) ROASTING FORK CLEANING ASSEMBLY

(71) Applicant: Michael Allen, West Jordan, UT (US)

(72) Inventor: Michael Allen, West Jordan, UT (US)

( * ) Notice: Subject to any disclaimer, the term of this patent is extended or adjusted under 35 U.S.C. 154(b) by 304 days.

(21) Appl. No.: 17/894,819

(22) Filed: Aug. 24, 2022

(65) Prior Publication Data

US 2024/0065426 A1 Feb. 29, 2024

(51) Int. Cl.

| | |
|---|---|
| ***A46B 9/02*** | (2006.01) |
| ***A46B 5/00*** | (2006.01) |
| ***A46B 17/02*** | (2006.01) |
| *A46D 1/00* | (2006.01) |

(52) U.S. Cl.

CPC ..... *A46B 5/005* (2013.01); *A46B 9/02* (2013.01); *A46B 17/02* (2013.01); *A46B 2200/30* (2013.01); *A46D 1/0207* (2013.01)

(58) Field of Classification Search

CPC ..... A47L 13/08; A46B 5/02; A46B 17/02; A47K 11/10; A46D 1/0207

See application file for complete search history.

(56) References Cited

U.S. PATENT DOCUMENTS

| | | | | |
|---|---|---|---|---|
| 2,236,323 | A * | 3/1941 | Stachowiak | A47L 13/08 30/169 |
| 3,535,047 | A | 10/1970 | Vireno | |
| 5,191,670 | A | 3/1993 | Lake | |
| 5,647,084 | A | 7/1997 | Still | |
| 5,915,794 | A * | 6/1999 | Neff | A47L 13/022 30/169 |
| 6,823,555 | B2 | 11/2004 | Warren | |
| 7,287,295 | B2 * | 10/2007 | Treacy | A47K 11/10 15/210.1 |
| 7,798,735 | B2 | 9/2010 | Barker | |
| D691,772 | S | 10/2013 | Blaisdell | |
| 9,936,855 | B1 | 4/2018 | Schmidt | |
| 2004/0129296 | A1 * | 7/2004 | Treacy | A47K 11/10 15/210.1 |
| 2011/0035894 | A1 | 2/2011 | Goldhammer | |
| 2012/0278984 | A1 * | 11/2012 | Eleftheriou | E03D 9/06 4/300 |
| 2016/0022019 | A1 * | 1/2016 | Gonzalez | A47J 37/0786 15/160 |
| 2019/0167063 | A1 * | 6/2019 | Balz | A46B 15/00 |
| 2019/0274418 | A1 * | 9/2019 | Gunjian | A46B 5/00 |
| 2020/0187731 | A1 * | 6/2020 | Luo | A47K 17/00 |
| 2021/0274924 | A1 * | 9/2021 | Zhang | A47K 17/00 |

FOREIGN PATENT DOCUMENTS

| | | |
|---|---|---|
| WO | WO2007057494 | 5/2007 |

* cited by examiner

*Primary Examiner* — Michael D Jennings

(57) ABSTRACT

A roasting fork cleaning assembly for cleaning food debris from a roasting fork includes a handle that includes a plurality of slidable sections such that the handle has a telescopically adjustable length. A grip is attached to the handle and a holder is attached to the handle. A collar is insertable into the holder thereby facilitating the roasting fork to be inserted into the collar when the collar is inserted into the holder. A plurality of bristles is each attached to the collar. Each of the bristles is directed toward a center of the collar thereby facilitating each of the bristles to abrade the roasting fork when the roasting fork is inserted into the collar. In this way the bristles can scrub food debris from the roasting fork.

11 Claims, 4 Drawing Sheets

ROASTING FORK CLEANING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to cleaning devices and more particularly pertains to a new cleaning device for cleaning food debris from a roasting fork. The device includes a telescopic handle and a holder, structured to have an ovoid shape, which is attached to the handle. The device includes a collar that is structured to have an ovoid shape that is insertable into the holder. The device includes a plurality of bristles that are integrated into the collar such that the bristles scrub a roasting fork that is inserted through the collar for scrubbing food debris from the roasting fork.

(2) Description of Related Art Including Information Disclosed Under 37 CFR 1.97 and 1.98

The prior art relates to cleaning devices including a variety of cleaning devices that each at least includes a U-shaped holder with opposing faces and a plurality of bristles each attached to a respective opposing face. The prior art discloses a variety of fork cleaning devices that each at least includes a tube and a plurality of bristles integrated within the tube for cleaning a fork inserted into the tube. The prior art discloses a foot cleaning device that includes a frame which includes a pair of horizontal members and a plurality of first bristles each attached to a respective horizontal member and a plurality of elongated brushes extending between respective horizontal members. The prior art discloses an ornamental design for a cutlery cleaner that includes an ovoid housing and a plurality of bristles disposed within the ovoid housing.

BRIEF SUMMARY OF THE INVENTION

An embodiment of the disclosure meets the needs presented above by generally comprising a handle that includes a plurality of slidable sections such that the handle has a telescopically adjustable length. A grip is attached to the handle and a holder is attached to the handle. A collar is insertable into the holder thereby facilitating the roasting fork to be inserted into the collar when the collar is inserted into the holder. A plurality of bristles is each attached to the collar. Each of the bristles is directed toward a center of the collar thereby facilitating each of the bristles to abrade the roasting fork when the roasting fork is inserted into the collar. In this way the bristles can scrub food debris from the roasting fork.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
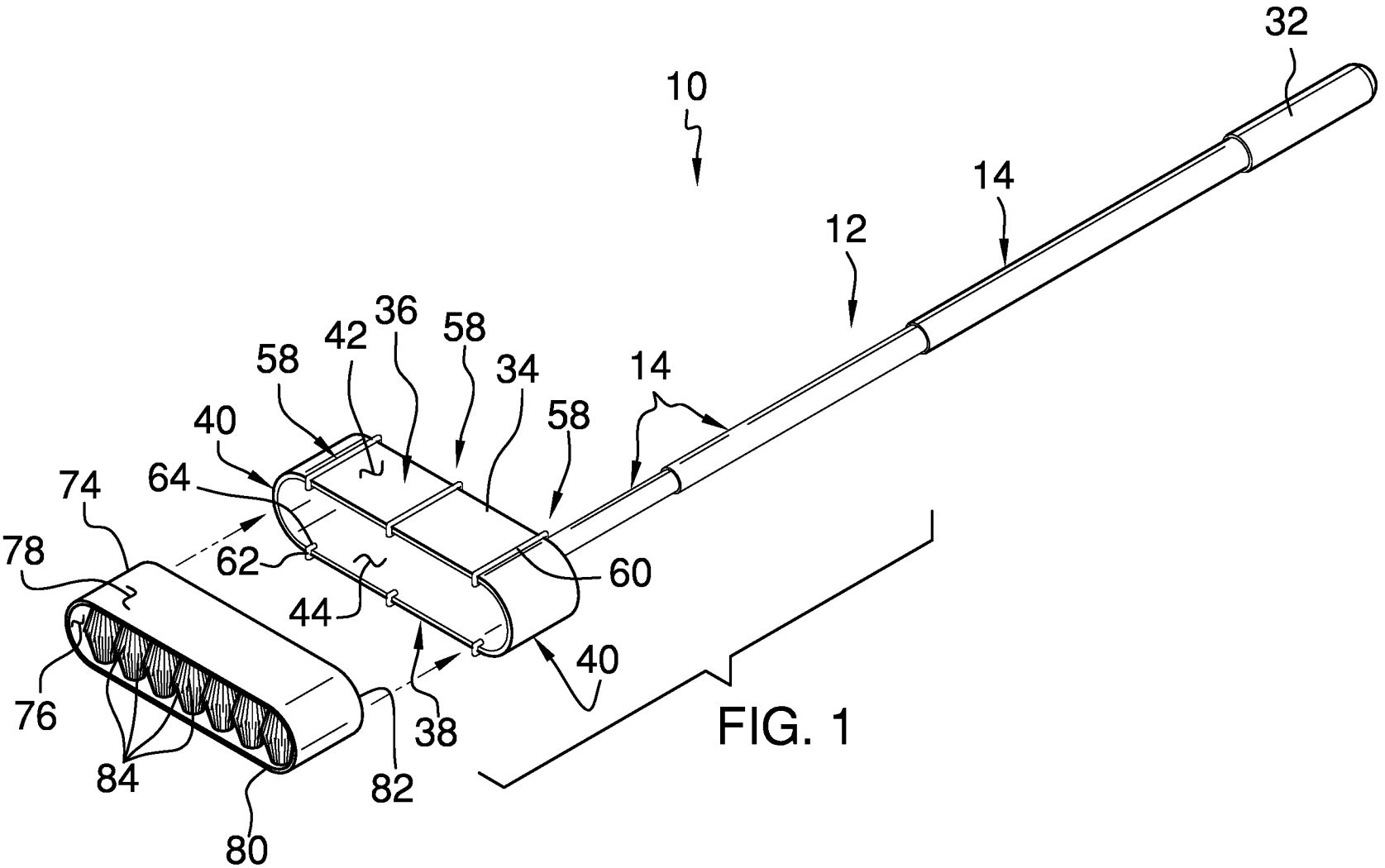
FIG. 1 is an exploded perspective view of a roasting fork cleaning assembly according to an embodiment of the disclosure.
Figure 2:
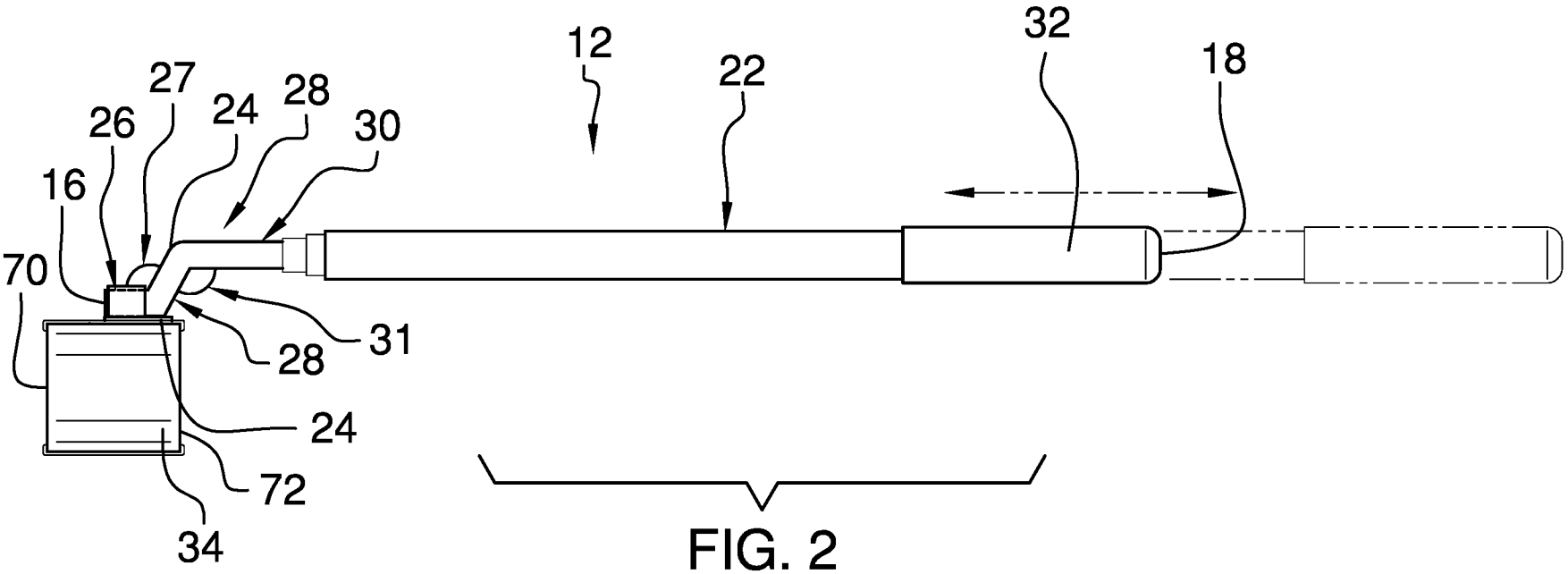
FIG. 2 is a left side view of an embodiment of the disclosure.
Figure 3:
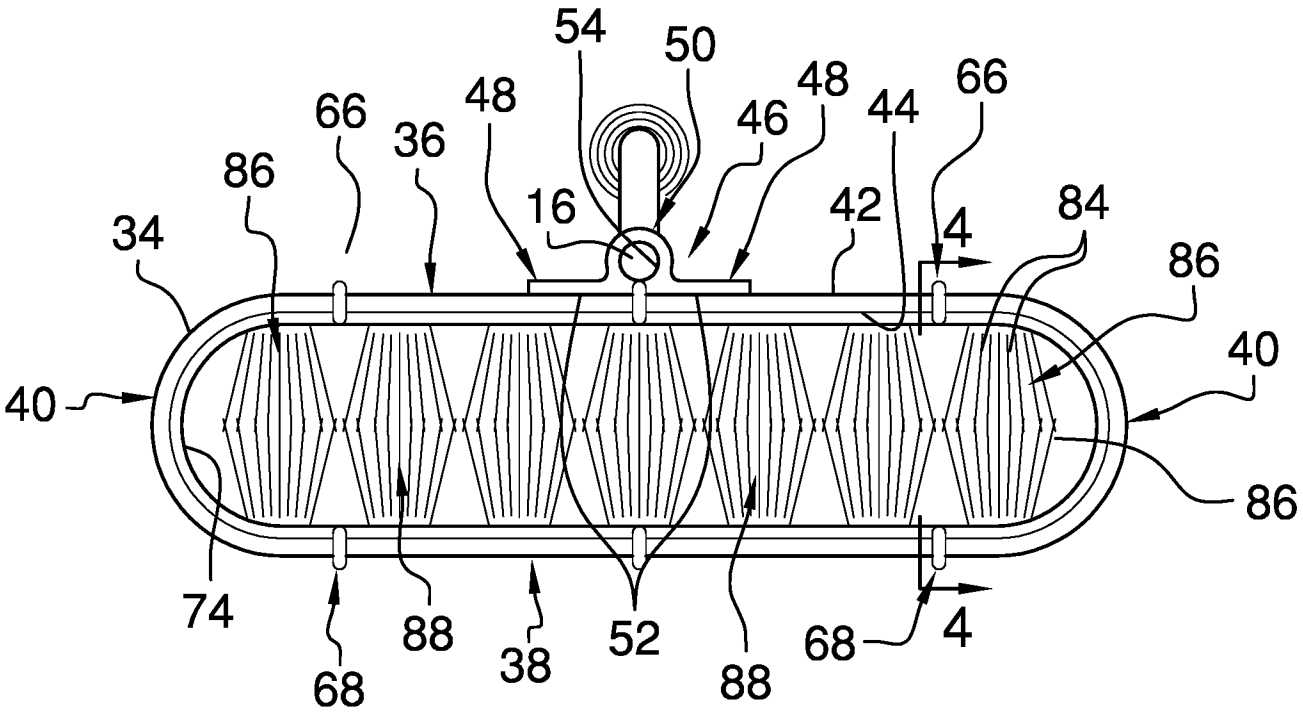
FIG. 3 is a front view of an embodiment of the disclosure.
Figure 4:
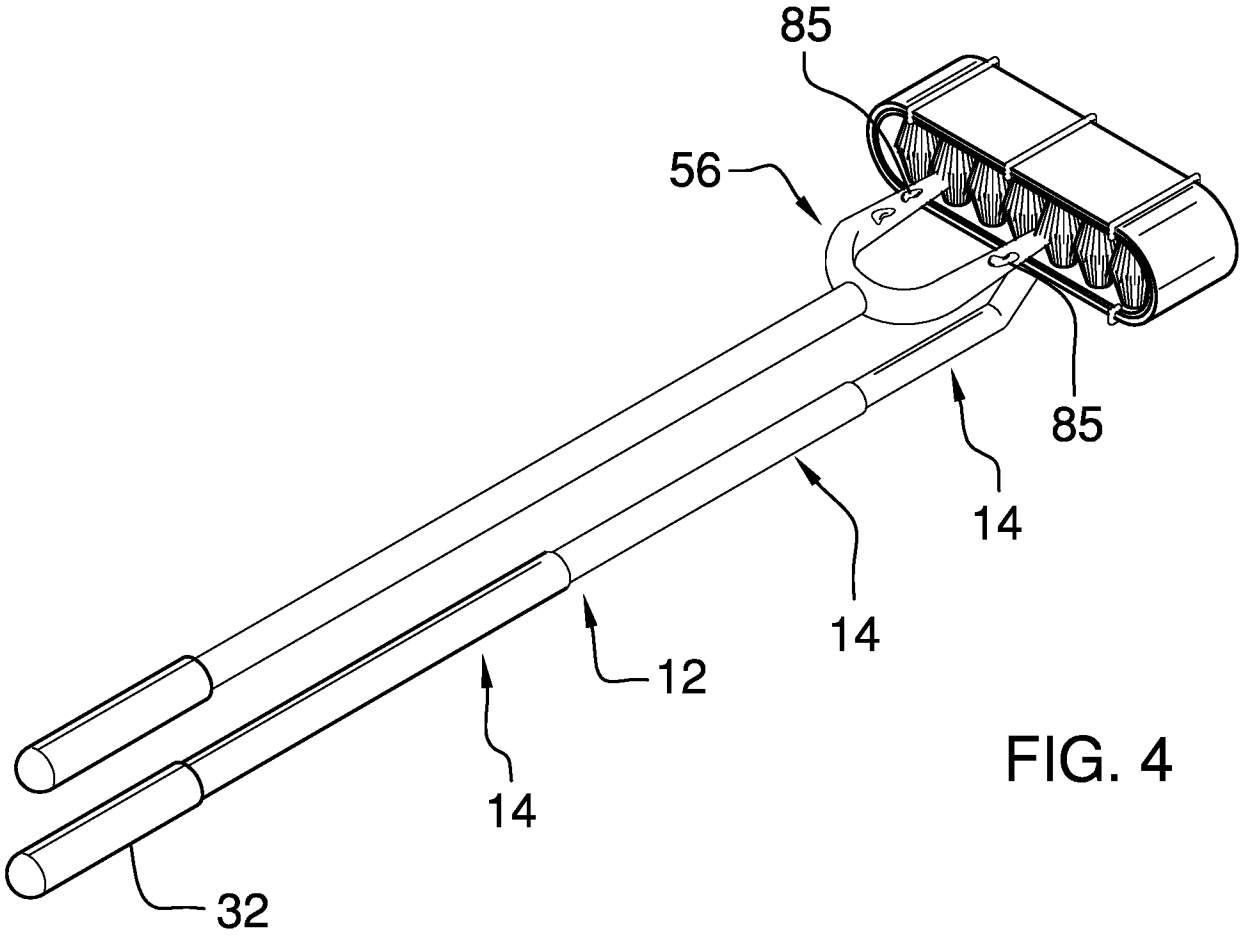
FIG. 4 is a perspective in-use view of an embodiment of the disclosure.

With reference now to the drawings, and in particular to FIGS. 1 through 4 thereof, a new cleaning device embodying the principles and concepts of an embodiment of the disclosure and generally designated by the reference numeral 10 will be described.

As best illustrated in FIGS. 1 through 4, the roasting fork cleaning assembly 10 generally comprises a handle 12 which comprises a plurality of slidable sections 14 such that the handle 12 has a telescopically adjustable length. The handle 12 has a first end 16 and a second end 18, and the plurality of slidable sections 14 includes a front section 20 and a rear section 22. The first end 16 is associated with the front section 20 and the second end 18 is associated with the rear section 22. The handle 12 has a pair of bends 24 that is each integrated into the front section 20 to define a first portion 26 of the front section 20 that is oriented at a first angle 27 with a second portion 28 of the front section 20 and a third portion 30 that is oriented at a second angle 31 with the second portion 28. Furthermore, the first angle 27 is congruent with the second angle 31 such that the first portion 26 is oriented parallel with the third portion 30. The first end 16 is associated with the first portion 26 and a respective one of the slidable sections 14 slidably engages the third portion 30.

A grip 32 is attached to the handle 12 and the grip 32 is positioned on the rear section 22 of the handle 12. The grip 32 extends from the second end 18 toward the first end 16 and the grip 32 is comprised of a rigid material, including but not being limited to, wood, plastic or other similar material. A holder 34 is attached to the handle 12 and the holder 34 is continuously arcuate such that the holder 34 defines a rounded shape. The holder 34 has an upper section 36, a lower section 38 and a pair of curved sections 40 each extending between the upper section 36 and the lower section 38. Each of the upper section 36 and the lower section 38 is elongated having each of the upper section 36 and the lower section 38 lying on a plane that is oriented parallel with each other. Each of the curved sections 40 is positioned on opposing ends of the upper section 36 and the lower section 38 with respect to each other. Additionally, each of the curved sections 40 curves outwardly with respect to a central axis that is oriented parallel with the upper section 36 and the lower section 38 such that the holder 34 defines an oval. The holder 34 has an outwardly facing surface 42 and an inwardly facing surface 44.

A receiver 46 is included that has a pair of planar portions 48 and a rounded portion 50 that is centrally positioned between the planar portions 48 having the rounded portion 50 curving upwardly from the planar portions 48. Each of the planar portions 48 has a first surface 52 and the first surface 52 of each of the planar portions 48 is bonded to the outwardly facing surface 42 of the holder 34 corresponding to the lower section 38 of the holder 34. The rounded portion 50 curves upwardly from the outwardly facing surface 42 corresponding to the upper section 36 and the receiver 46 is centrally positioned between the pair of curved sections 40. Furthermore, the receiver 46 is oriented such that the rounded portion 50 defines an opening 54 which has a central axis that is perpendicularly oriented with respect to an axis extending between the pair of curved sections 40 of the holder 34. The first portion 26 of the front section 20 of the handle 12 extends through the opening 54 defined by the rounded portion 50 of the receiver 46. The second portion 28 of the front section 20 of the handle 12 angles downwardly and rearwardly from the lower section 38 of the holder 34 thereby facilitating a roasting fork 56 to be inserted through the holder 34 without contacting the handle 12. The roasting fork 56 may be a roasting fork that would commonly be employed for roasting marshmallows over a camp fire, for example.

A plurality of retainers 58 is provided and each of the retainers 58 is coupled to the holder 34. Each of the retainers 58 includes a member 60 and a pair of legs 62 each extending downwardly from opposing ends of the member 60 and a pair of feet 64 each extending away from a respective one of the legs 62. The feet 64 on each of the retainers 58 are directed toward each other. The plurality of retainers 58 includes a set of first retainers 66 and a set of second retainers 68. Each of the first retainers 66 is positioned on the upper section 36 of the holder 34 and the first retainers 66 are spaced apart from each other and are distributed between each of the curved sections 40 of the holder 34.

The member 60 of each of the first retainers 66 extends along the outwardly facing surface 42 of the holder 34 corresponding to the upper section 36. Each of the legs 62 of each of the first retainers 66 extends downwardly along a respective one of a front edge 70 and a back edge 72 of the upper section 36. Each of the feet 64 of each of the first retainers 66 extends along the inwardly facing surface 44 of the upper section 36. The member 60 of each of the second retainers 68 extends along the outwardly facing surface 42 of the holder 34 corresponding to the upper section 36. Each of the legs 62 of each of the second retainers 68 extends downwardly along a respective one of the front edge 70 and the back edge 72 of the upper section 36. Additionally, each of the feet 64 of each of the second retainers 68 extends along the inwardly facing surface 44 of the upper section 36 and each of the first retainers 66 and the second retainers 68 is comprised of a resiliently compressible material.

A collar 74 is insertable into the holder 34 thereby facilitating the roasting fork 56 to be inserted into the collar 74 when the collar 74 is inserted into the holder 34. Each of the retainers 58 engages the collar 74 for removably retaining the collar 74 in the holder 34. The collar 74 has an interior surface 76, an exterior surface 78, a forward edge 80 and a rearward edge 82. The collar 74 is structured such that the exterior surface 78 conforms to the inwardly facing surface 44 of the holder 34 when the collar 74 is inserted into the holder 34. The rearward edge 82 abuts a respective one of the feet 64 of each of the first retainers 66 and the second retainers 68 when the collar 74 is inserted into the holder 34. The forward edge 80 abuts a respective one of the feet 64 of each of the first retainers 66 and the second retainers 68 when the collar 74 is inserted into the holder 34. Additionally, the collar 74 has a first portion 26 that is spaced from and is oriented parallel with a second portion 28.

A plurality of bristles 84 is provided and each of the bristles 84 is attached to the collar 74. Each of the bristles 84 is directed toward a center of the collar 74 thereby facilitating each of the bristles 84 to abrade the roasting fork 56 when the roasting fork 56 is inserted into the collar 74. In this way the bristles 84 can scrub food debris 85 from the roasting fork 56. Each of the bristles 84 is attached to the interior surface 76 of the collar 74 and each of the bristles 84 has a distal end 86 with respect to the interior surface 76. Each of the bristles 84 is comprised of a rigid material to abrade the food debris 85 from the roasting fork 56. Furthermore, each of the bristles 84 is comprised of a heat resistant material, including but not being limited to stainless steel, such that bristles 84 resist being melted from the roasting fork 56 when the roasting fork 56 is hot due to being inserted into a fire.

The plurality of bristles 84 is arranged into a set of first bristles 86 and a set of second bristles 88. Each of the first bristles 86 is positioned on the first portion 26 of the collar 74 and each the second bristles 88 is positioned on the second portion 28 of the collar 74. Additionally, each of the sets of first bristles 86 is aligned with a respective set of the second bristles 88. Each of the set of first bristles 86 is oriented to angle outwardly between the first portion 26 of the collar 74 and the distal end 86 of each of the first bristles 86 such that each of the sets of first bristles 86 defines a frusto-conical shape. Additionally, each of the second bristles 88 is oriented to angle outwardly between the second portion 28 of the collar 74 and the distal end 86 of each of the second bristles 88 such that each of the sets of second bristles 88 defines a frusto-conical shape.

In use, the collar 74 is inserted into the holder 34 and the handle 12 is adjusted to a desired length. The roasting fork 56 is inserted into the collar 74 such that a handle 12 of the roasting fork 56 is aligned with the handle 12 attached to the holder 34. The roasting fork 56 is urged back and forth thereby facilitating the bristles 84 to scrub food debris 85 from the roasting fork 56. In this way burnt marshmallow, for example, can be efficiently cleaned from the roasting fork 56. The collar 74 can be replaced with a new collar 74 when the bristles 84 become deformed or otherwise worn out from extended use.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A roasting fork cleaning assembly for cleaning food debris from a roasting fork, said assembly comprising:

a handle comprising a plurality of slidable sections such that said handle has a telescopically adjustable length;

a grip being attached to said handle;

a holder being attached to said handle, said holder being continuously arcuate such that said holder defines a rounded shape;

a plurality of retainers, each of said retainers being coupled to said holder;

a collar being insertable into said holder, said collar being configured for the roasting fork to be inserted into said collar when said collar is inserted into said holder, each of said retainers engaging said collar for removably retaining said collar in said holder;

a plurality of bristles, each of said bristles being attached to said collar, each of said bristles being directed toward a center of said collar wherein said bristles are configured to abrade the roasting fork when the roasting fork is inserted into said collar wherein said bristles are configured to scrub food debris from the roasting fork;

wherein said handle has a first end and a second end;

wherein said plurality of slidable sections includes a front section and a rear section, said first end being associated with said front section, said second end being associated with said rear section;

wherein said handle has a pair of bends each being integrated into said front section to define a first portion of said front section being oriented at a first angle with a second portion of said front section and a third portion being oriented at a second angle with said second portion;

wherein said first angle being congruent with said second angle such that said first portion is oriented parallel with said third portion;

wherein said first end being associated with said first portion; and wherein a respective one of said slidable sections slidably engages said third portion.

2. The assembly according to claim 1, wherein said grip is positioned on said rear section of said handle, said grip extending from said second end toward said first end.

3. The assembly according to claim 2, wherein:

said holder has an upper section, a lower section and a pair of curved sections each extending between said upper section and said lower section, each of said upper section and said lower section being elongated having each of said upper section and said lower section lying on a plane being oriented parallel with each other;

each of said curved sections being positioned on opposing ends of said upper section and said lower section with respect to each other, each of said curved sections curving outwardly with respect to a central axis being oriented parallel with said upper section and said lower section such that said holder defines an oval; and said holder has an outwardly facing surface and an inwardly facing surface.

4. The assembly according to claim 3, further comprising:

a receiver having a pair of planar portions and a rounded portion being centrally positioned between said planar portions having said rounded portion curving upwardly from said planar portions, each of said planar portions having a first surface;

said first surface of each of said planar portions is bonded to said outwardly facing surface of said holder corresponding to said lower section of said holder such that said rounded portion curves upwardly from said outwardly facing surface corresponding to said upper section;

said receiver is centrally positioned between said pair of curved sections;

said receiver is oriented such that said rounded portion defines an opening which has a central axis being perpendicularly oriented with respect to an axis extending between said pair of curved sections; and said first portion of said front section of said handle extends through said opening defined by said rounded portion of said receiver.

5. The assembly according to claim 4, wherein said second portion of said front section of said handle angles downwardly and rearwardly from said lower section of said holder wherein said holder is configured for a roasting fork to be inserted through said holder without contacting said handle.

6. A roasting fork cleaning assembly for cleaning food debris from a roasting fork, said assembly comprising:

a handle comprising a plurality of slidable sections such that said handle has a telescopically adjustable length;

a grip being attached to said handle;

a holder being attached to said handle, said holder being continuously arcuate such that said holder defines a rounded shape;

a plurality of retainers, each of said retainers being coupled to said holder;

a collar being insertable into said holder, said collar being configured for the roasting fork to be inserted into said collar when said collar is inserted into said holder, each of said retainers engaging said collar for removably retaining said collar in said holder;

a plurality of bristles, each of said bristles being attached to said collar, each of said bristles being directed toward a center of said collar wherein said bristles are configured to abrade the roasting fork when the roasting fork is inserted into said collar wherein said bristles are configured to scrub food debris from the roasting fork; and wherein each of said retainers includes a member and a pair of legs each extending downwardly from opposing ends of said member and a pair of feet each extending away from a respective one of said legs, said feet on each of said retainers being directed toward each other.

7. The assembly according to claim 6, wherein:

said holder has an outwardly facing surface and an inwardly facing surface, said holder having an upper section, a lower section and a pair of curved sections each extending between said upper section and said lower section;

said plurality of retainers includes a set of first retainers and a second set of retainers;

each of said first retainers is positioned on said upper section of said holder, said first retainers being spaced apart from each other and being distributed between each of said curved sections of said holder, said member of each of said first retainers extending along said outwardly facing surface of said holder corresponding to said upper section, each of said legs of each of said first retainers extending downwardly along a respective one of a front edge and a back edge of said upper section, each of said feet of each of said first retainers extending along said inwardly facing surface of said upper section;

said member of each of said second retainers extends along said outwardly facing surface of said holder corresponding to said upper section, each of said legs of each of said second retainers extending downwardly along a respective one of a front edge and a back edge of said upper section, each of said feet of each of said second retainers extending along said inwardly facing surface of said upper section; and each of said first retainers and said second retainers is comprised of a resiliently compressible material.

8. The assembly according to claim 7, wherein:

said collar has an interior surface, an exterior surface, a forward edge and a rearward edge, said collar being structured such that said exterior surface conforms to said inwardly facing surface of said holder when said collar is inserted into said holder;

said rearward edge abuts a respective one of said feet of each of said first retainers and said second retainers when said collar is inserted into said holder;

said forward edge abuts a respective one of said feet of each of said first retainers and said second retainers when said collar is inserted into said holder; and said collar has a first portion being spaced from and being oriented parallel with a second portion.

9. The assembly according to claim 8, wherein:

each of said bristles is attached to said interior surface of said collar, each of said bristles having a distal end with respect to said interior surface;

each of said bristles is comprised of a rigid material wherein said plurality of bristles is configured to abrade the food debris from the roasting fork; and each of said bristles being comprised of a heat resistant material wherein said plurality of bristles is configured to resist being melted from the roasting fork when the roasting fork is hot from being inserted into a fire.

10. The assembly according to claim 9, wherein said plurality of bristles is arranged into a set of first bristles and a set of second bristles, each of said first bristles being positioned on said first portion of said collar, each said second bristles being positioned on said second portion of said collar, each of said sets of first bristles being aligned with a respective set of said second bristles.

11. A roasting fork cleaning assembly for cleaning food debris from a roasting fork, said assembly comprising:

a handle comprising a plurality of slidable sections such that said handle has a telescopically adjustable length, said handle having a first end and a second end, said plurality of slidable sections including a front section and a rear section, said first end being associated with said front section, said second end being associated with said rear section, said handle having a pair of bends each being integrated into said front section to define a first portion of said front section being oriented at a first angle with a second portion of said front section and a third portion being oriented at a second angle with said second portion, said first angle being congruent with said second angle such that said first portion is oriented parallel with said third portion, said first end being associated with said first portion, a respective one of said slidable sections slidably engaging said third portion;

a grip being attached to said handle, said grip being positioned on said rear section of said handle, said grip extending from said second end toward said first end;

a holder being attached to said handle, said holder being continuously arcuate such that said holder defines a rounded shape, said holder having an upper section, a lower section and a pair of curved sections each extending between said upper section and said lower section, each of said upper section and said lower section being elongated having each of said upper section and said lower section lying on a plane being oriented parallel with each other, each of said curved sections being positioned on opposing ends of said upper section and said lower section with respect to each other, each of said curved sections curving outwardly with respect to a central axis being oriented parallel with said upper section and said lower section such that said holder defines an oval, said holder having an outwardly facing surface and an inwardly facing surface;

a receiver having a pair of planar portions and a rounded portion being centrally positioned between said planar portions having said rounded portion curving upwardly from said planar portions, each of said planar portions having a first surface, said first surface of each of said planar portions being bonded to said outwardly facing surface of said holder corresponding to said lower section of said holder such that said rounded portion curves upwardly from said outwardly facing surface corresponding to said upper section, said receiver being centrally positioned between said pair of curved sections, said receiver being oriented such that said rounded portion defines an opening which has a central axis being perpendicularly oriented with respect to an axis extending between said pair of curved sections of said holder, said first portion of said front section of said handle extending through said opening defined by said rounded portion of said receiver, said second portion of said front section of said handle angling downwardly and rearwardly from said lower section of said holder wherein said holder is configured for a roasting fork to be inserted through said holder without contacting said handle;

a plurality of retainers, each of said retainers being coupled to said holder, each of said retainers including a member and a pair of legs each extending downwardly from opposing ends of said member and a pair of feet each extending away from a respective one of said legs, said feet on each of said retainers being directed toward each other, said plurality of retainers including a set of first retainers and a second set of retainers, each of said first retainers being positioned on said upper section of said holder, said first retainers being spaced apart from each other and being distributed between each of said curved sections of said holder, said member of each of said first retainers extending along said outwardly facing surface of said holder corresponding to said upper section, each of said legs of each of said first retainers extending downwardly along a respective one of a front edge and a back edge of said upper section, each of said feet of each of said first retainers extending along said inwardly facing surface of said upper section, said member of each of said second retainers extending along said outwardly facing surface of said holder corresponding to said upper section, each of said legs of each of said second retainers extending downwardly along a respective one of a front edge and a back edge of said upper section, each of said feet of each of said second retainers extending along said inwardly facing surface of said upper section, each of said first retainers and said second retainers being comprised of a resiliently compressible material;

a collar being insertable into said holder wherein the collar is configured for the roasting fork to be inserted into said collar when said collar is inserted into said holder, each of said retainers engaging said collar for removably retaining said collar in said holder, said collar having an interior surface, an exterior surface, a forward edge and a rearward edge, said collar being structured such that said exterior surface conforms to said inwardly facing surface of said holder when said collar is inserted into said holder, said rearward edge abutting a respective one of said feet of each of said first retainers and said second retainers when said collar is inserted into said holder, said forward edge abutting a respective one of said feet of each of said first retainers and said second retainers when said collar is inserted into said holder, said collar having a first portion being spaced from and being oriented parallel with a second portion; and a plurality of bristles, each of said bristles being attached to said collar, each of said bristles being directed toward a center of said collar wherein each of said bristles is configured to abrade the roasting fork when the roasting fork is inserted into said collar wherein said bristles are configured to scrub food debris from the roasting fork, each of said bristles being attached to said interior surface of said collar, each of said bristles having a distal end with respect to said interior surface, each of said bristles being comprised of a rigid material wherein said plurality of bristles is configured to abrade the food debris from the roasting fork, each of said bristles being comprised of a heat resistant material wherein said plurality of bristles is configured to resist being melted from the roasting fork when the roasting fork is hot from being inserted into a fire, said plurality of bristles being arranged into a set of first bristles and a set of second bristles, each of said first bristles being positioned on said first portion of said collar, each said second bristles being positioned on said second portion of said collar, each of said sets of first bristles being aligned with a respective set of said second bristles.

* * * * *